United States Patent [19]

Schweitzer et al.

[11] Patent Number: 5,066,950

[45] Date of Patent: Nov. 19, 1991

[54] TRAFFIC SAFETY MONITORING APPARATUS

[75] Inventors: Naftali Schweitzer; Joseph S. Bodenheimr, both of Jerusalem; Gerald B. David, Savion, all of Israel

[73] Assignee: Driver Safety Systems Ltd., Herzliya on Sea, Israel

[21] Appl. No.: 344,161

[22] Filed: Apr. 27, 1989

[30] Foreign Application Priority Data

Apr. 27, 1988 [IL] Israel ..... 86202

[51] Int. Cl.[5] ..... G08G 1/017; G08G 1/054

[52] U.S. Cl. ..... 340/937; 340/936; 340/942; 364/438; 358/113

[58] Field of Search ..... 340/937, 936, 942, 933-935, 340/938-939, 943; 358/113, 110, 108; 364/438

[56] References Cited

U.S. PATENT DOCUMENTS

| | | | |
|---|---|---|---|
| 2,250,442 | 7/1941 | Abell . | |
| 2,619,402 | 11/1952 | McCutcheon . | |
| 2,769,165 | 10/1956 | Bower . | |
| 2,813,468 | 11/1957 | Jones . | |
| 3,165,373 | 1/1965 | Scott . | |
| 3,181,150 | 4/1965 | Ruppersberg et al. . | |
| 3,206,748 | 9/1965 | Miller . | |
| 3,516,056 | 6/1970 | Matthews | 340/942 |
| 3,544,958 | 12/1970 | Carey et al. . | |
| 3,690,233 | 9/1972 | Billingsley . | |
| 3,788,201 | 1/1974 | Abell . | |
| 3,827,070 | 7/1974 | Hoerenz et al. . | |
| 3,840,848 | 10/1974 | Marshall et al. . | |
| 3,849,784 | 11/1974 | Holzapfel . | |
| 4,063,820 | 12/1977 | Borgese . | |
| 4,173,010 | 10/1979 | Hoffmann . | |
| 4,214,265 | 7/1980 | Olesen | 340/937 |
| 4,648,718 | 3/1987 | Sadamitsu et al. . | |
| 4,652,765 | 3/1987 | Nishihara . | |
| 4,847,772 | 7/1989 | Michalopoulos et al. | 340/937 |

*Primary Examiner*—Donnie L. Crosland

*Attorney, Agent, or Firm*—Panitch Schwarze Jacobs & Nadel

[57] ABSTRACT

A traffic monitoring system comprising apparatus for establishing a pair of precisely spaced radiation beams in association with a thoroughfare, whereby passage of a vehicle along the thoroughfare interrupts the radiation beams, apparatus for sending interruption of the radiation beams and providing output indications of vehicle speed and separation between adjacent vehicles (headway) and apparatus for photographing vehicles fulfilling predetermined criteria including photography trigger apparatus which is responsive to the sensed vehicle speed of the vehicle being photographed for providing a consistently positioned photographic record of the vehicle, irrespective of vehicle speed.

19 Claims, 12 Drawing Sheets a= ELECTRONIC CIRCUIT
b= LED DRIVER

NOTE: THE SECTION BETWEEN P1-P2 CAN BE EXECUTED IN PARALLEL WITH THE REST OF THE PROGRAM.

TRAFFIC SAFETY MONITORING APPARATUS

FIELD OF THE INVENTION

The present invention relates to monitoring apparatus and more particularly to traffic safety monitoring apparatus.

BACKGROUND OF THE INVENTION

Various devices are known for monitoring traffic for the purpose of detecting violations of speed and anti-tailgating regulations. Examples of such systems are described in the following U.S. Patents: U.S. Pat. No. 3,840,848 describes a system for multiple vehicle gap detection and interval sensing. U.S. Pat. No. 3,690,233 describes apparatus for photographing passing cars. U.S. Pat. No. 4,173,010 describes a system for recording vehicle speed and photographing vehicles.

The existing systems for traffic monitoring have disadvantages: they often have difficulties distinguishing trucks from a chain of cars and they do not produce pictures in which the violating vehicle is consistently at the same distance from the camera, thus providing consistent positive identification of the vehicle.

Furthermore, existing systems do not provide comprehensive internal calibration and do not provide an output record of violations which includes confirmation of the calibration.

SUMMARY OF THE INVENTION

The present invention seeks to provide an improved traffic monitoring system which overcomes the above-mentioned disadvantages.

There is thus provided in accordance with a preferred embodiment of the present invention a traffic monitoring system comprising apparatus for establishing a pair of precisely spaced radiation beams in association with a thoroughfare, whereby passage of a vehicle along the thoroughfare interrupts the radiation beams, apparatus for sensing interruption of the radiation beams and providing output indications of vehicle speed and separation between adjacent vehicles (headway) and apparatus for photographing vehicles fulfilling predetermined criteria including photography trigger apparatus which is responsive to the sensed vehicle speed of the vehicle being photographed for providing a consistently positioned photographic record of the vehicle, irrespective of vehicle speed.

Additionally in accordance with a preferred embodiment of the invention there is provided a traffic monitoring system comprising apparatus for establishing a pair of precisely spaced radiation beams in association with a thoroughfare, whereby passage of a vehicle along the thoroughfare interrupts the radiation beams, apparatus for sensing interruption of the radiation beams and providing output indications of vehicle speed and separation between adjacent vehicles and wherein the apparatus for sensing includes apparatus for distinguishing between separate vehicles, multi-axle trucks and tractor-trailer combinations.

Additionally in accordance with a preferred embodiment of the invention there is provided a traffic monitoring system comprising apparatus for establishing a pair of precisely spaced radiation beams in association with a thoroughfare, whereby passage of a vehicle along the thoroughfare interrupts the radiation beams, apparatus for sensing interruption of the radiation beams and providing output indications of vehicle speed and separation between adjacent vehicles and means for photographing not only a tailgating vehicle but also a vehicle being tailgated, that is a vehicle which maintains insufficient headway with respect to a preceding vehicle, and such preceding vehicle.

Further in accordance with a preferred embodiment of the invention, there is provided a traffic monitoring system comprising apparatus for establishing a pair of precisely spaced radiation beams in association with a thoroughfare, whereby passage of a vehicle along the thoroughfare interrupts the radiation beams, apparatus for sensing interruption of the radiation beams and providing output indications of vehicle speed and separation between adjacent vehicles and means for checking the output indications for consistency against stored data so as to eliminate spurious output indications. The stored data may include upper and lower limits of speed, headway and vehicle length which would exclude, for example, non-motor vehicles and animals.

Additionally in accordance with a preferred embodiment of the invention, there is provided apparatus for providing a comprehensive calibration check and apparatus for recording confirmation of calibration together with a violation record of violations. The calibration check may include checks as to signal/noise ratios and other operating criteria which could affect the accuracy of the traffic monitoring system.

Further in accordance with an embodiment of the invention, apparatus may be provided for providing an output indication of traffic law violation in near real time to a monitor, such as a policeman.

BRIEF DESCRIPTION OF THE DRAWINGS

The present invention will be understood and appreciated more fully from the following detailed description taken in conjunction with the drawings in which.

DETAILED DESCRIPTION OF A PREFERRED EMBODIMENT

Reference is now made to FIGS. 1, 2A, 2B and 3 which illustrate apparatus for traffic monitoring constructed and operative in accordance with a preferred embodiment of the present invention. The apparatus comprises a support structure 10, which is preferably portable and supports a transceiver assembly 12.

Transceiver assembly 12 is preferably arranged so as to provide a pair of precisely spaced parallel beams 13 of radiation, preferably infrared radiation in the wavelength band of 800–950 nanometers, which impinge on precisely spaced reflectors 14 associated with a thoroughfare, such that the beams are reflected to the transceiver assembly 12.

It is a particular feature of the present invention that the orientation of the beams 13 with respect to vehicles passing along the thoroughfare is such that the front and the back of each vehicle cause respective interruption and re-establishment of the beam and further that long multiple axle vehicles are distinguished from a chain of cars. This is achieved by employing a steep beam angle as illustrated in FIG. 1A or alternatively, a vertical beam which impinges on the body of the vehicle. A preferred angle of elevation of the beams 13 in FIG. 1A is 17 to 23 degrees from the horizontal.

Figure 1:
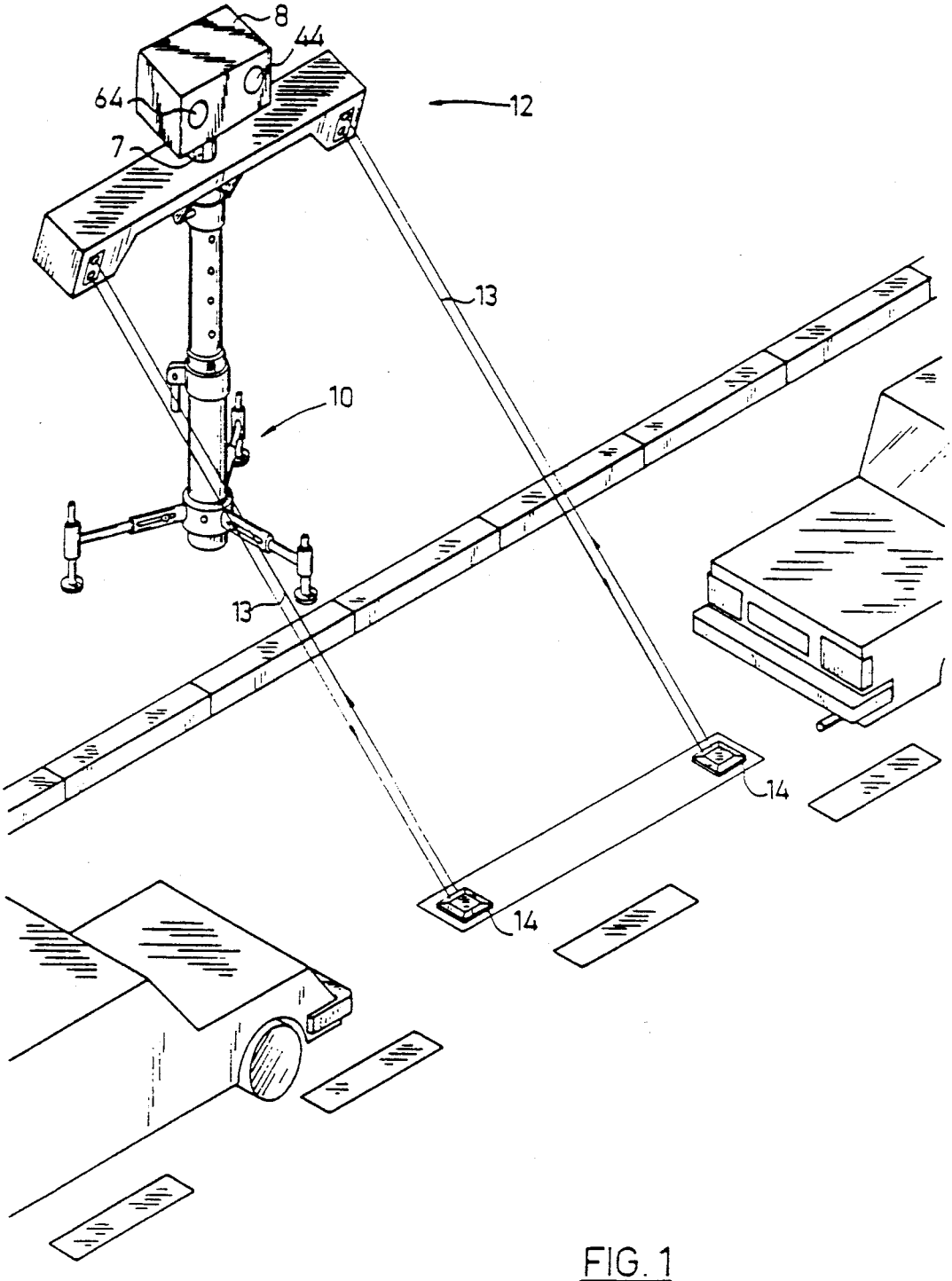
FIG. 1 is a pictorial illustration of traffic monitoring apparatus constructed and operative in accordance with a preferred embodiment of the present invention.
Figure 2A:
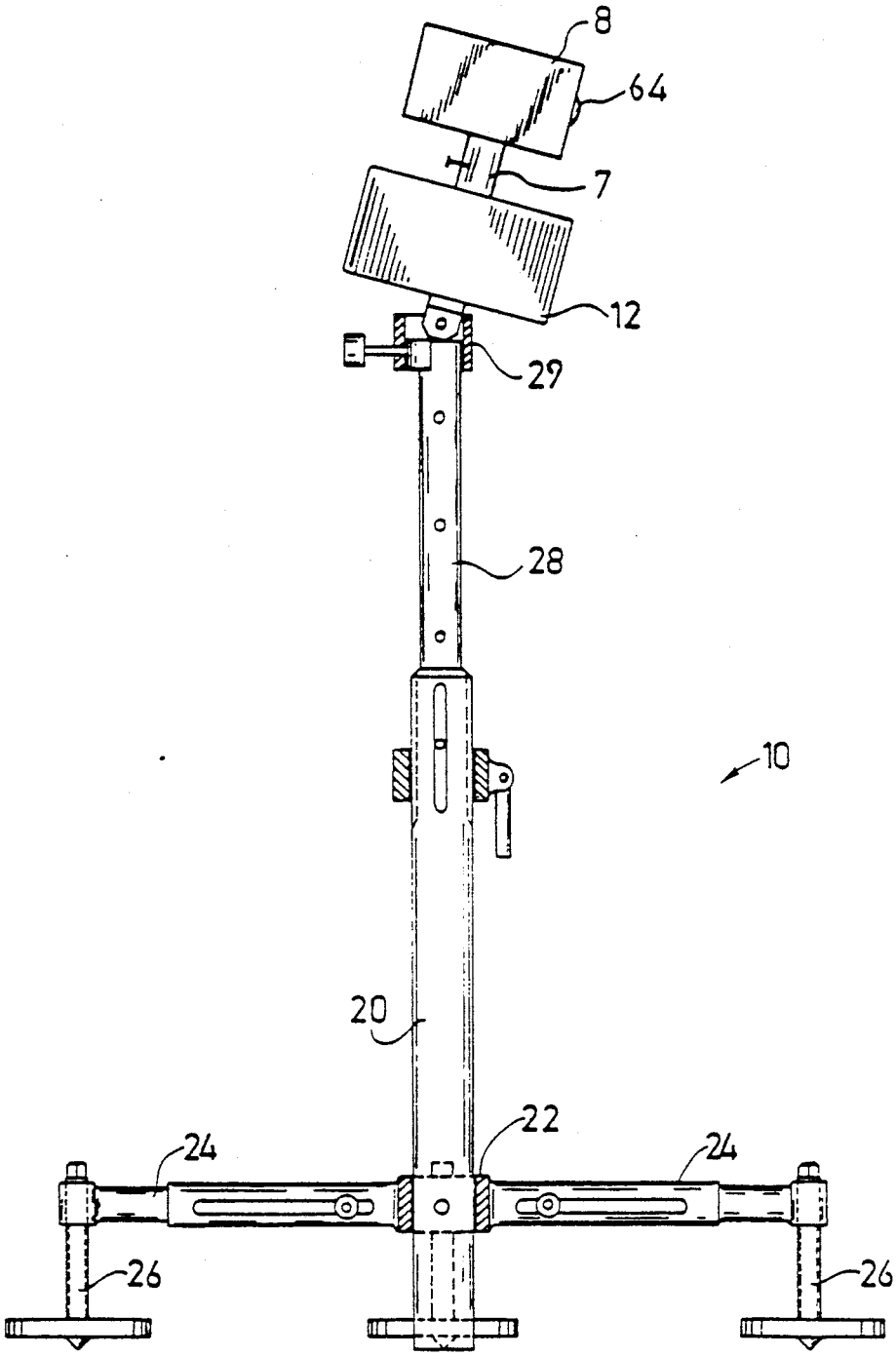
FIG. 2A is a detailed mechanical illustration of mounting apparatus for employed in the traffic law monitoring apparatus of FIG. 1.

It may be seen from FIG. 2A that the support structure comprises a base shaft 20 which is supported by a support collar 22 defining transversely extending legs 24 having associated therewith adjustable leg supports 26. A telescoping shaft 28 is adjustably mounted with respect to base shaft 20 and supports the transceiver assembly 12 via a selectably fixable pivotable support mechanism 29. A video camera 44, such as a CCD camera, and a flash unit 64, such as a METZ 45CT3, together comprise an assembly 8 which is adjustably mounted with respect to the transceiver assembly 12 via a swivelable and tiltable mechanism 7, such as the head of a camera tripod.

According to an alternative embodiment of the present invention, the support structure 10 is fixably attached to the ground.

Figure 2B:
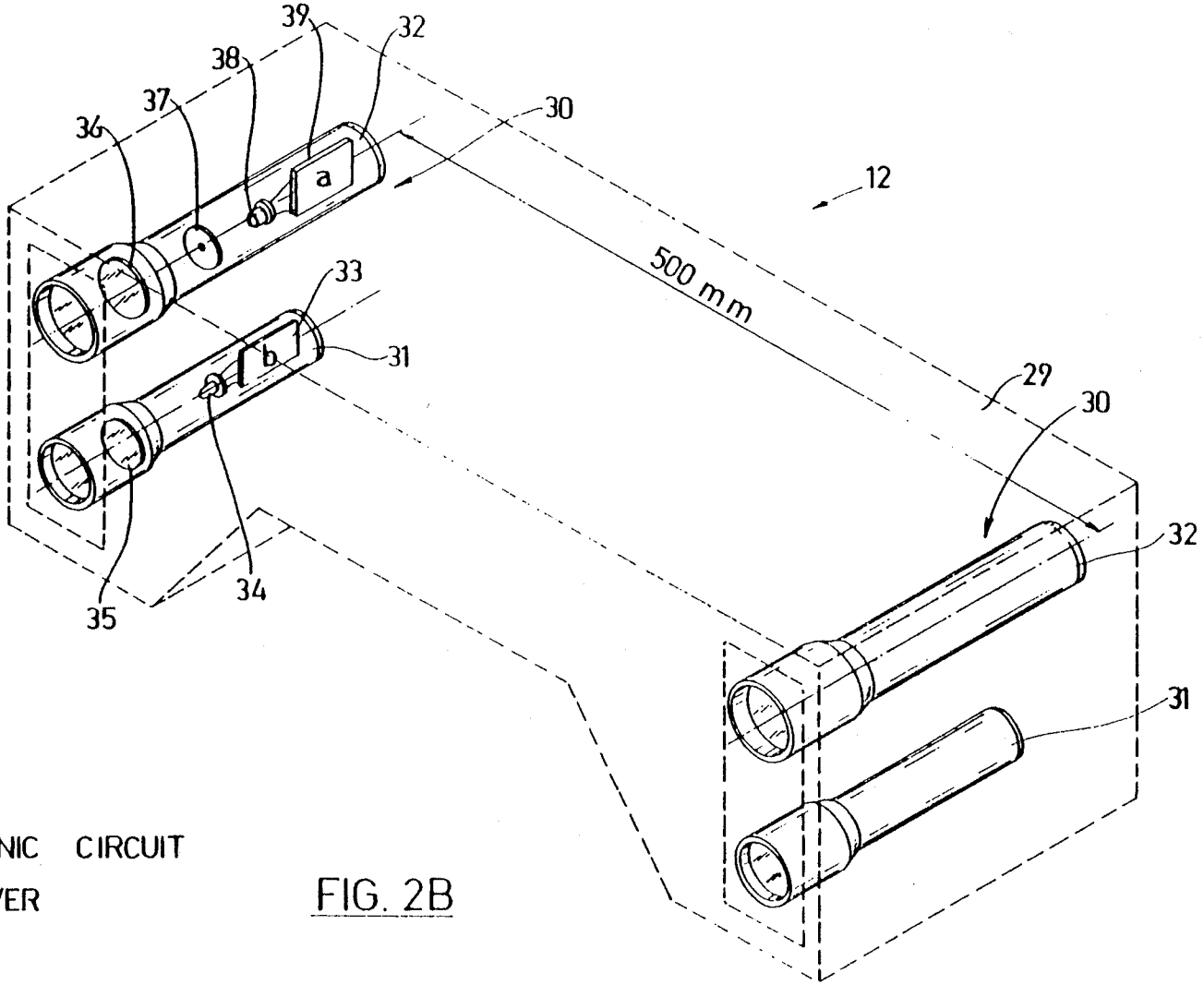
FIG. 2B is a simplified optical illustration of transceiver apparatus employed in the invention.

Reference is now made to FIG. 2B, which illustrates transceiver assembly 12. The transceiver assembly includes a housing 29 and a pair of combinations 30 of a transmitter 31 and a receiver 32. Each transmitter typically comprises an LED driver 33, an LED 34 and a lens 35, while each receiver typically comprises a lens 36, an aperture and filter 37, a photodetector 38 and output amplification circuitry 39.

Figure 3:
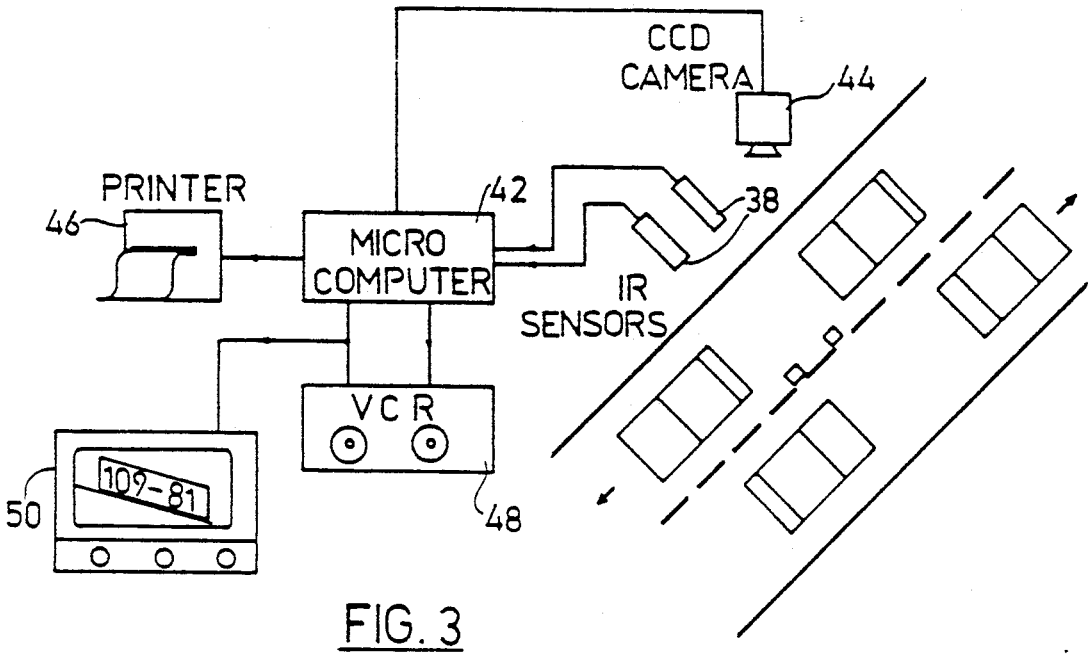
FIG. 3 is a simplified block diagram illustration of a traffic law monitoring system constructed and operative in accordance with a preferred embodiment of the present invention.

Reference is now made to FIG. 3, which illustrates the traffic monitoring system of the invention from a system standpoint. A pair of precisely spaced infra-red sensors, such as photodetectors 38, forming part of transceiver assembly 12 (FIG. 2A), provide an output to a microcomputer 42, which also receives an input from the camera 44, which photographs vehicles passing along the thoroughfare. The microcomputer 42 may be coupled to a printer 46, which provides a written record of the activities of the traffic monitoring system, to a video recorder 48 and optionally to a television monitor 50.

Figure 4:
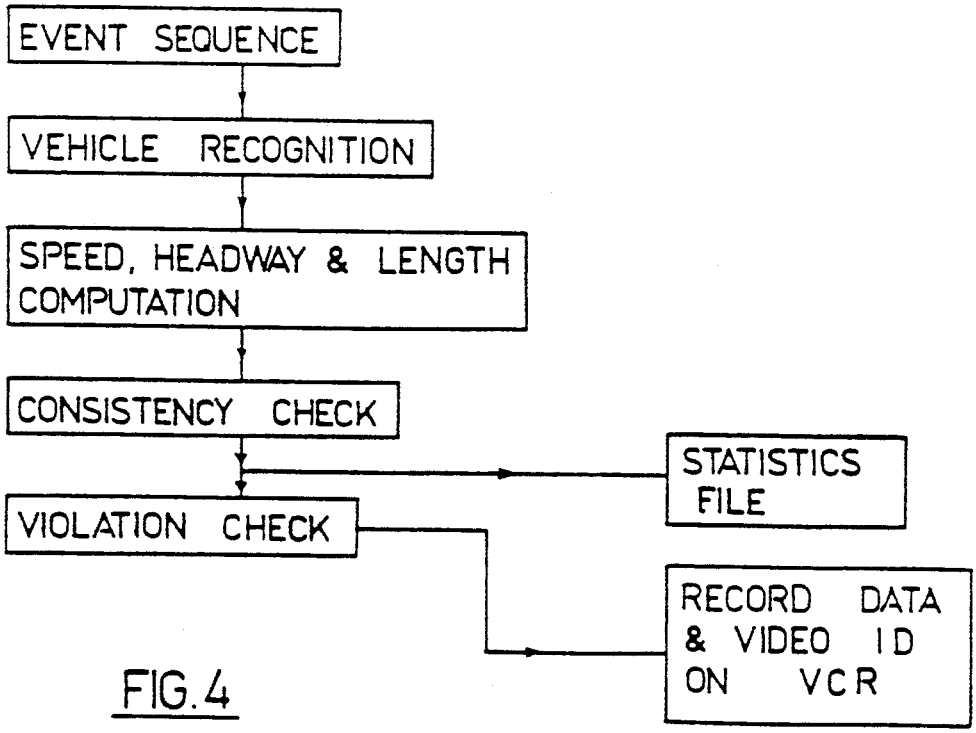
FIG. 4 is a simplified flow chart illustration of the operation of the system of FIG. 3.

The general sequence of operations of the system shown in FIG. 3 is set forth in the flow chart of FIG. 4. It is seen that upon the occurrence of each event, such as the passing of a vehicle along the monitored thoroughfare, data is received by photodetectors 38 and by the camera 44. As a result, the vehicle is recognized and its speed, headway and length are determined.

The speed, headway and length determinations are checked for consistency with stored data setting reasonable ranges of values for these parameters. If the parameters are found to fall within allowable ranges, a violation check is performed, to determine whether speed or tailgating offenses have been committed. In the event that such an offense has been committed, the relevant data are recorded together with a photograph of the vehicle identification.

Figure 5:
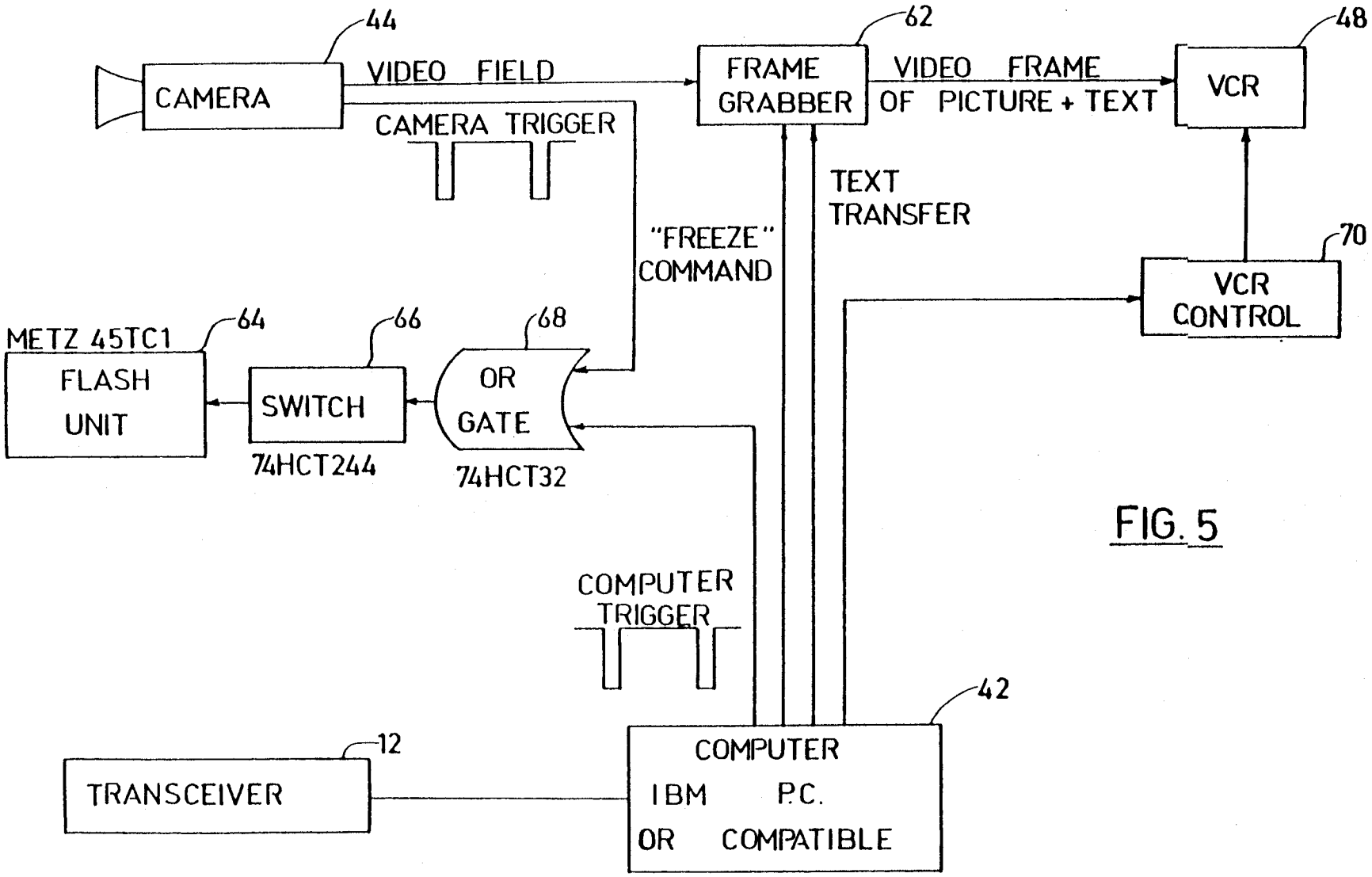
FIG. 5 is a block diagram illustration of a photographic subsystem forming part of the system of FIG. 3.

Reference is now made to FIG. 5, which illustrates a recording subsystem of the system of FIG. 3. It is seen that the output of a fast video camera 44, such as an EEV "PHOTON" CCD camera, is supplied to a frame grabber circuit 62, such as PC Vision Plus, available from Imaging Technology of the U.S.A. Micro computer 42 obtains information from transceiver assembly 12 and performs the violation determinations.

The frame grabber circuit is operative to combine a video picture from camera 44 with text describing the violation received from a micro computer 42, such as a Zenith PC, which controls the operation of the frame grabber circuitry 62. A video recorder 48, such as a conventional video recorder, JVC BR1600EG/EK, manufactured by JVC of Japan, records the output of frame grabber circuit 62 in accordance with instructions received from micro computer 42 via control circuitry 70.

The flash unit 64 is controlled by a switch 66, such as 74HCT244, by trigger inputs from computer 42 and camera 44 via an OR gate 68.

Figure 6:
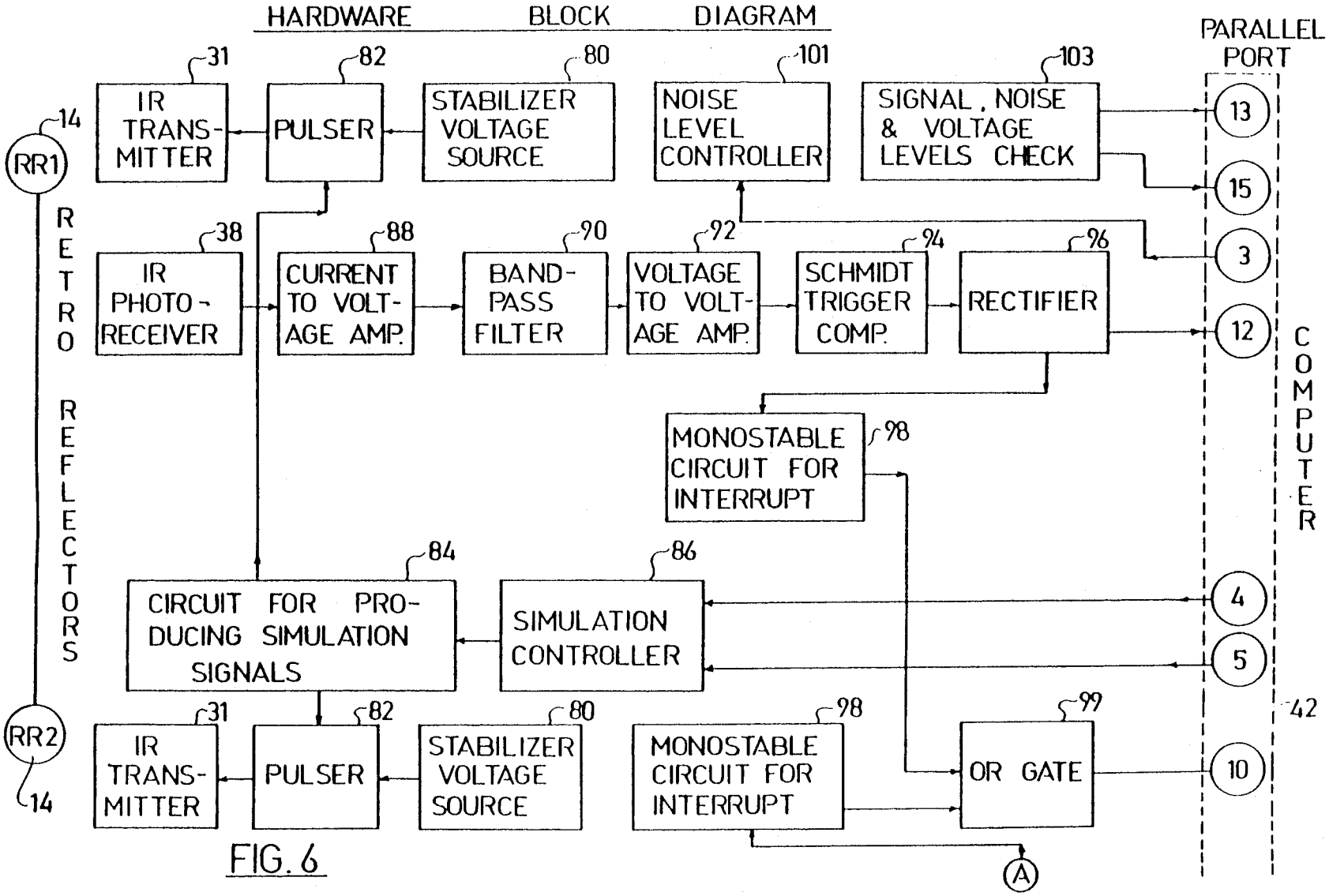
FIGS. 6 and 6A are a detailed functional block diagram of the system of FIG. 3.
Figure 6A:
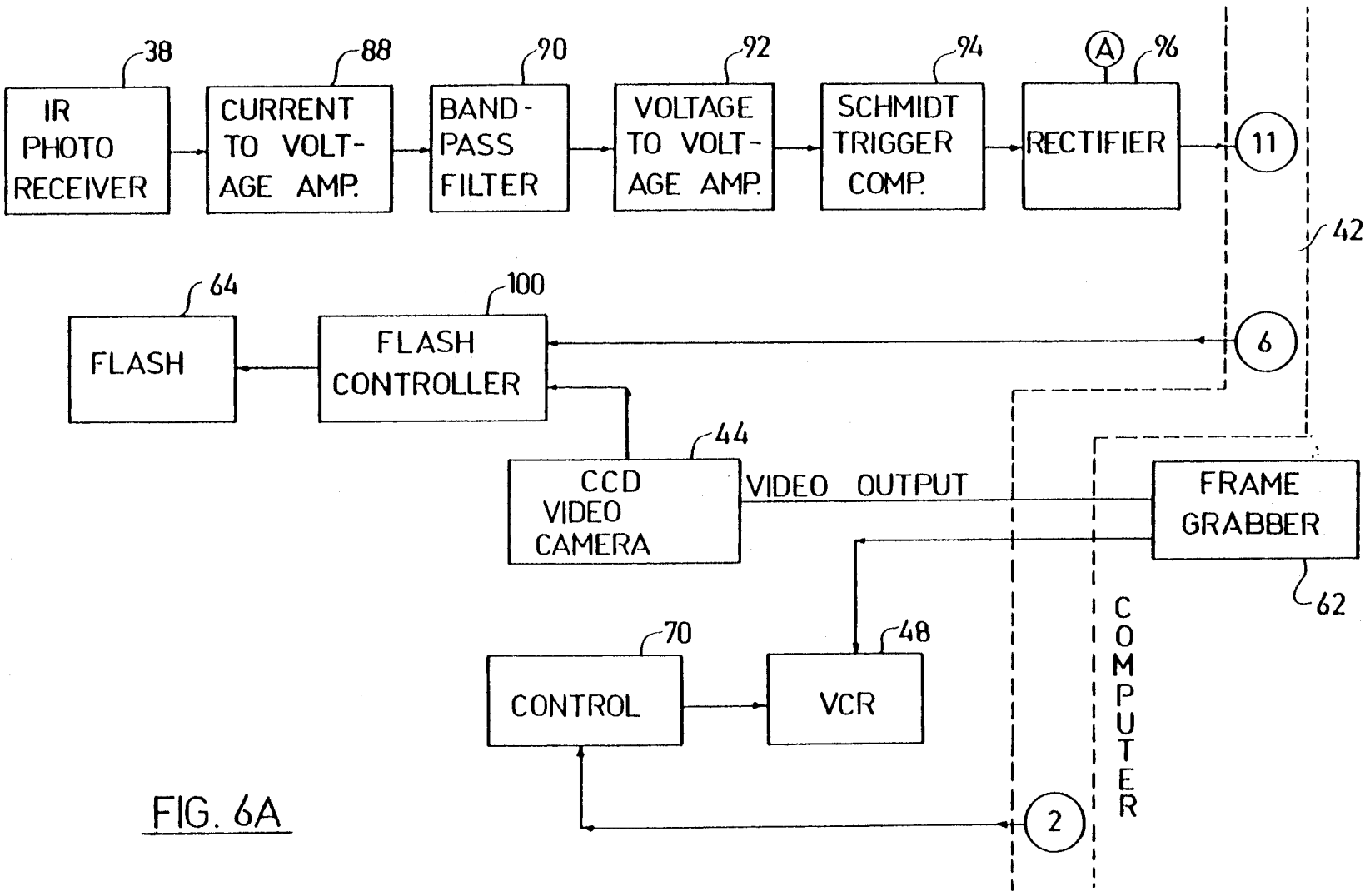

Reference is now made to FIGS. 6 and 6A, which are a functional block diagram of part of the circuitry of FIG. 3. Transmitters 31 receive voltage inputs from stabilized voltage sources 80 via pulsers 82. The pulsers 82 receive inputs from a circuit 84 for producing simulation signals, which receives a control input from a simulation controller 86, which is connected typically to ports 4 and 5 of computer 42.

Photodetectors 38 output via current to voltage amplifiers 88, band pass filters 90 and voltage to voltage amplifiers 92 to Schmidt triggers 94. The outputs of the Schmidt triggers are supplied via rectifiers 96 and monostable circuits 98 to an OR gate 99 and the output of OR gate 99 is supplied to port 10 of computer 42. Flash unit 64 is controlled by a flash controller 100 which receives an input from port 6 of computer 42 and also receives an input from CCD video camera 44.

The video output of camera 44 is supplied, as mentioned above, to frame grabber circuit 62, which outputs to VCR 48, which receives control inputs via control circuitry 70 from port 2 of the computer. A noise level controller 101 is coupled to port 3 of the computer 42 and signal, noise and voltage level check circuits 103 are coupled to ports 13 and 15 of the computer 42.

Figure 7:
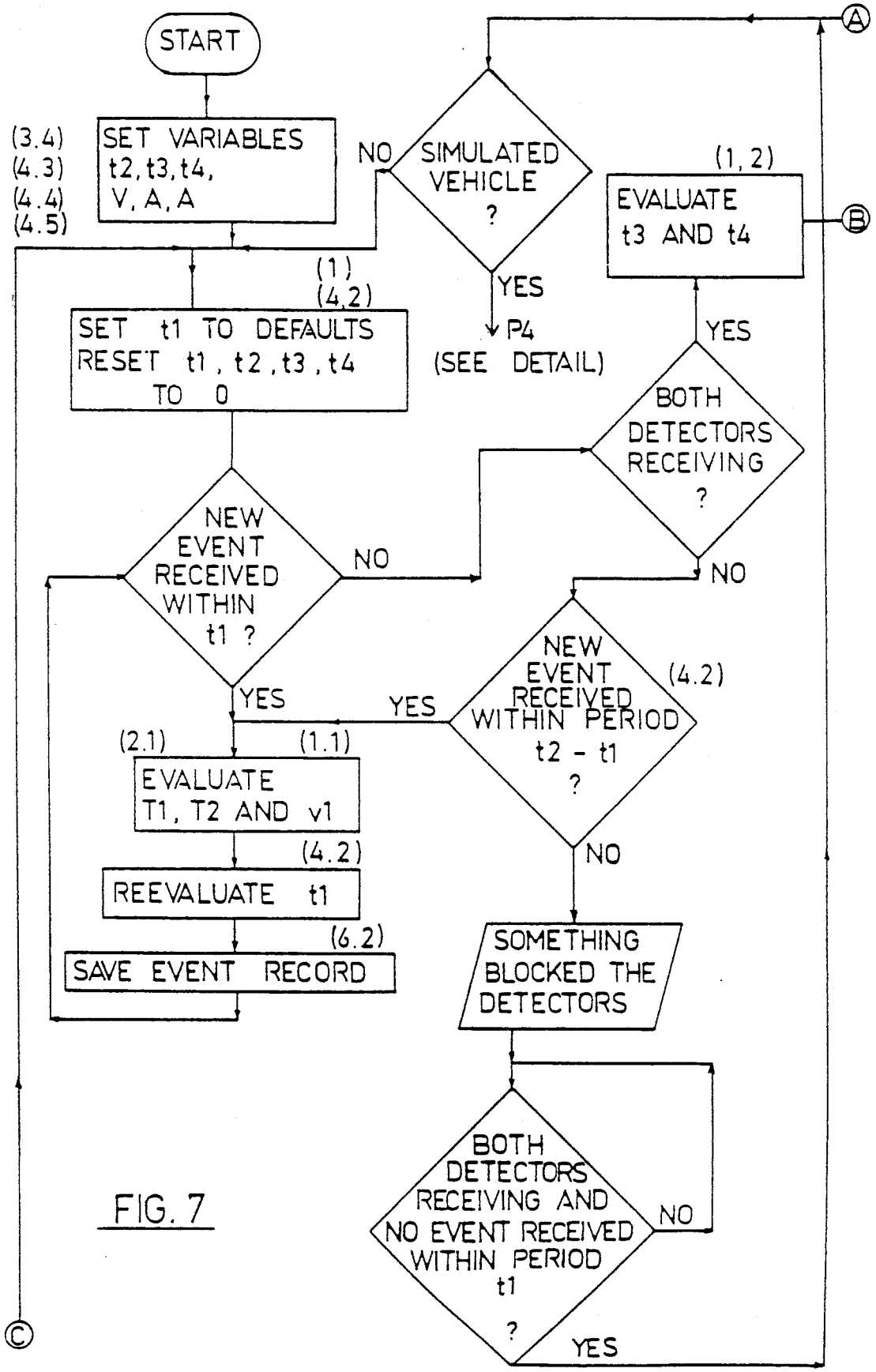
FIGS. 7, 7A and 7B are a flow chart illustrating the general operation of the system of the present invention.
Figure 7A:
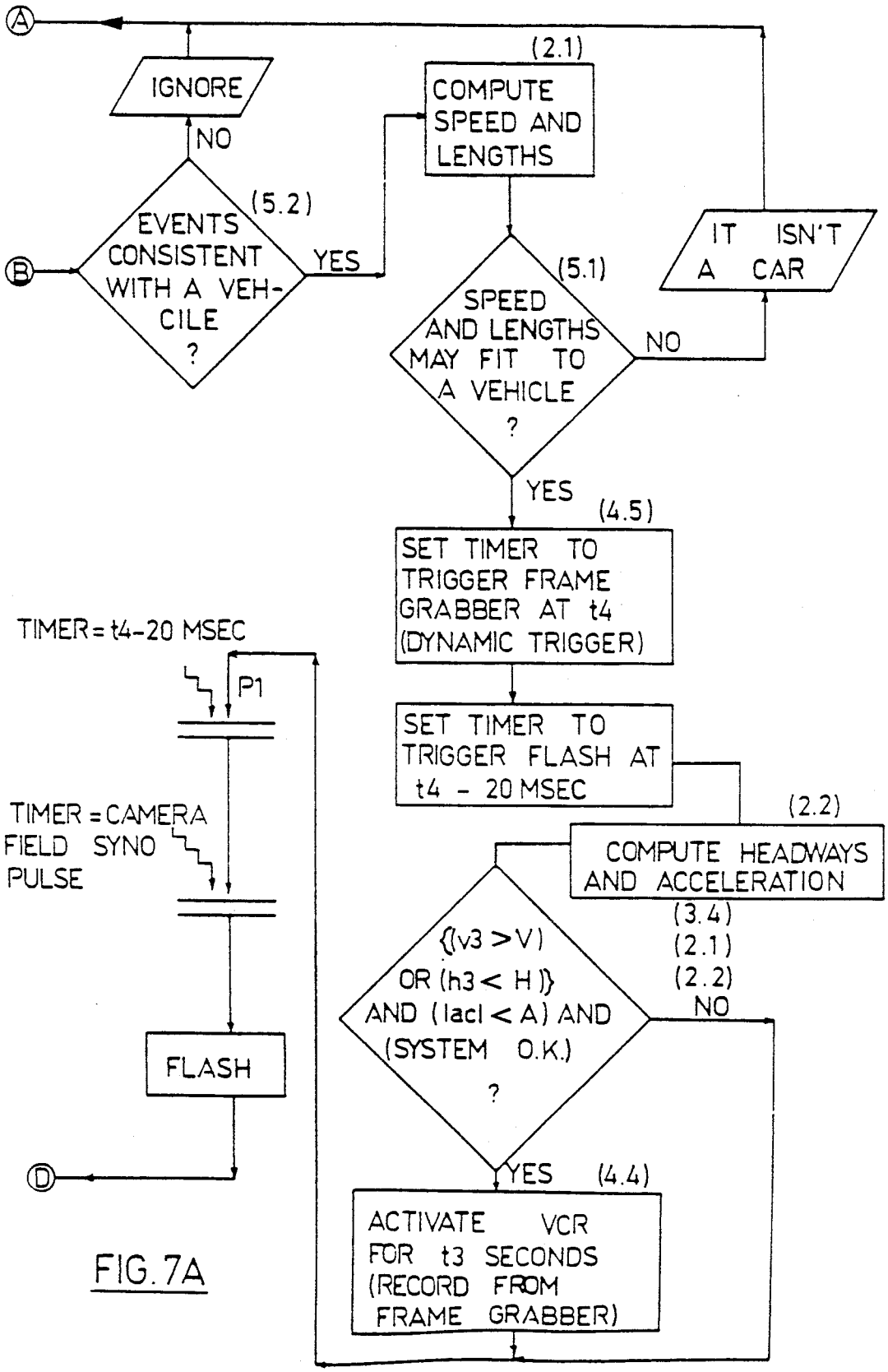
Figure 7B:
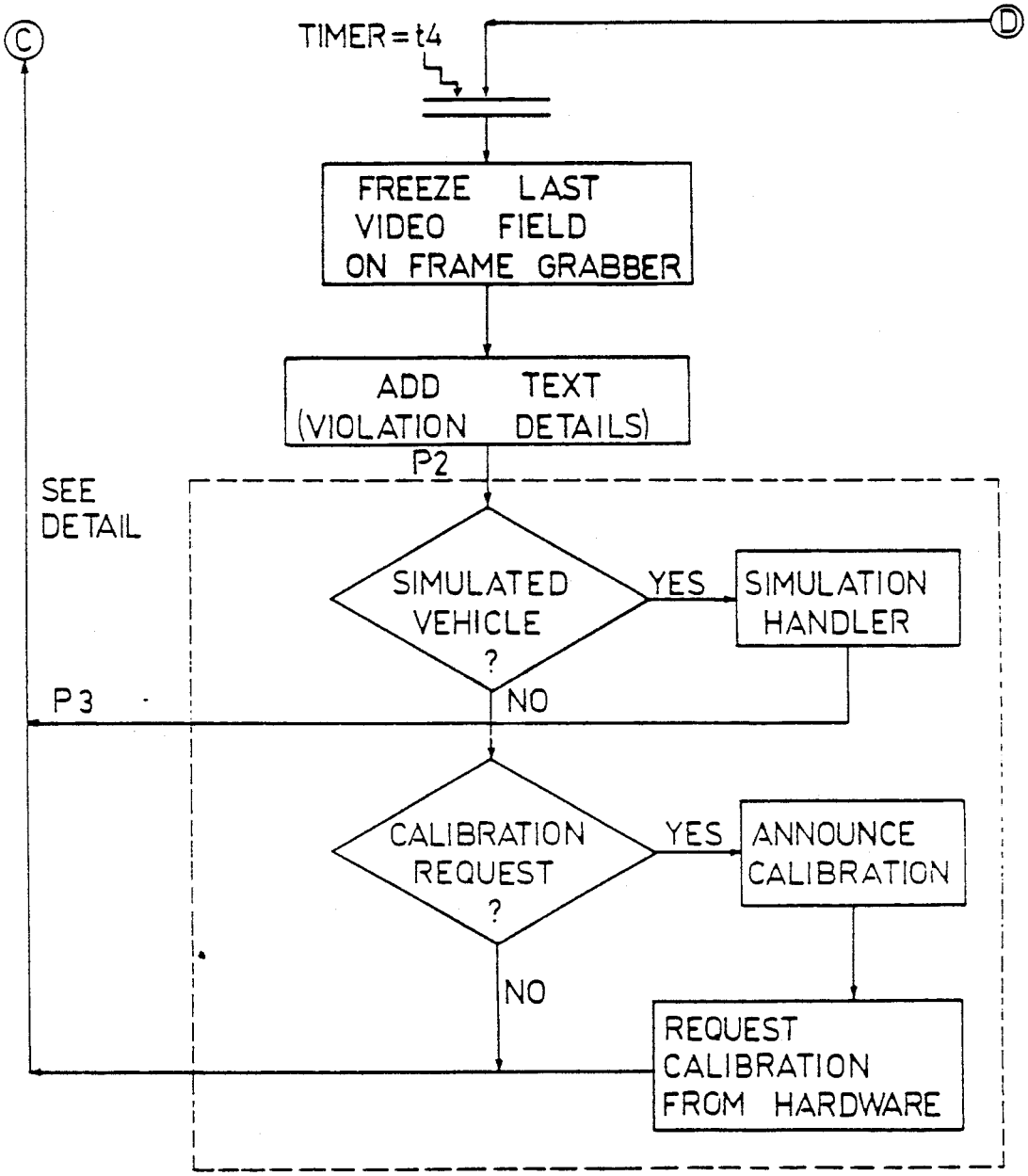

The general operation of the system will now be briefly summarized with reference to the flow chart of FIGS. 7, 7A, and 7B.

Every vehicle that crosses beams 13 produces four detection events which are used to analyze its speed, length and headway:

T1 = The time that the front of the vehicle enters the first beam (First event at DET1)

T2 = The time that the front of the vehicle enters the second beam (First event at DET2)

T3 = The time that the rear of the vehicle exits the first beam (Last event at DET1)

T4 = The time that the rear of the vehicle exits the second beam (First event at DET2) From the above four events, the following information is obtained:

$$v1 = dd/(T2 - T1) = \textit{Speed of front of vehicle}$$

$$v2 = dd/(T4 - T3) = \textit{Speed of rear of vehicle}$$

$v3 = min\ (v1, v2)$ $va = (v1 + v2)/2 = Average\ speed$ $L1 = va \times (T3 - T1) = Length\ of\ vehicle\ at\ DET1$ $L2 = va \times (T4 - T2) = Length\ of\ vehicle\ at\ DET2$ $La = (L1 + L2)/2 = Average\ length$ $h1 = T1(of\ present\ vehicle) - T3(of\ previous\ vehicle) = headway\ at\ DET1$ $h2 = T2(of\ present\ vehicle) - T4\ (of\ previous\ vehicle) = headway\ at\ DET2$ $h3 = max\ (h1, h2)$ $ac = 2\ (v2 - v1)/(T4 + T3 - T2 - T1) = Acceleration\ of\ vehicle$ The following constants are established:

dd = distance between beams, more particularly, the distance between the positions in each beam that activate the Schmidt triggers 94, preferably 500 mm.

maxv = maximum speed detected, preferably 200 km/h minv = minimum speed detected, preferably 16 km/h maxl = maximum length detected, preferably 20 meter minl = minimum length detected, preferably 2 meter minh = minimum headway detected, preferably 2 meter A = maximum reasonable acceleration V = maximum speed permitted H = minimum headway time permitted d = fixed distance from DET2 at which vehicle is to be when picture of vehicle is required, preferably between 5-10 meters.

$t1$ in default = $dd\ /\ minv$ set = $minh\ /\ v1$, if $v1$ is known for the vehicle $t2 = maxl/minv$ $t3 = picture\ record\ time$ $t4 = d/v1 = dynamic\ trigger.$ (*Alternatively instead of* $v1$, $v2$ *or* $va$ *may be used.*)

Identification of a vehicle is established if the following criteria are fulfilled:

v1 < maxv AND v2 < maxv AND

L1 > or equal to minl AND

L2 > or equal to minl

The events characterize a vehicle if and only if:

0 < T1 < T2 < T3 < T4

The operation of the system proceeds generally as outlined in FIG. 7.

Figure 8:
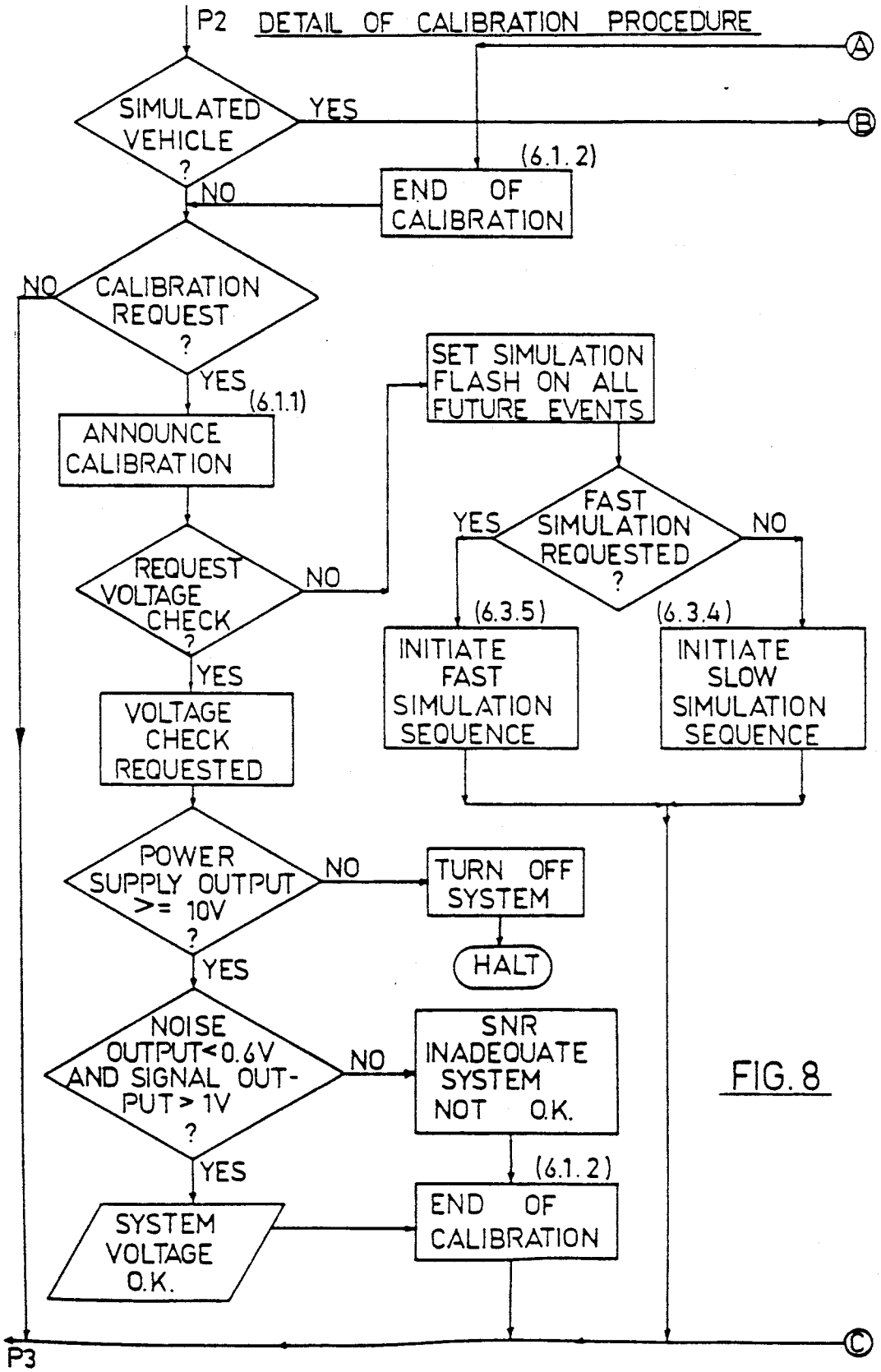
FIGS. 8 and 8A are a flow chart illustrating the calibration of the system of the present invention.
Figure 8A:
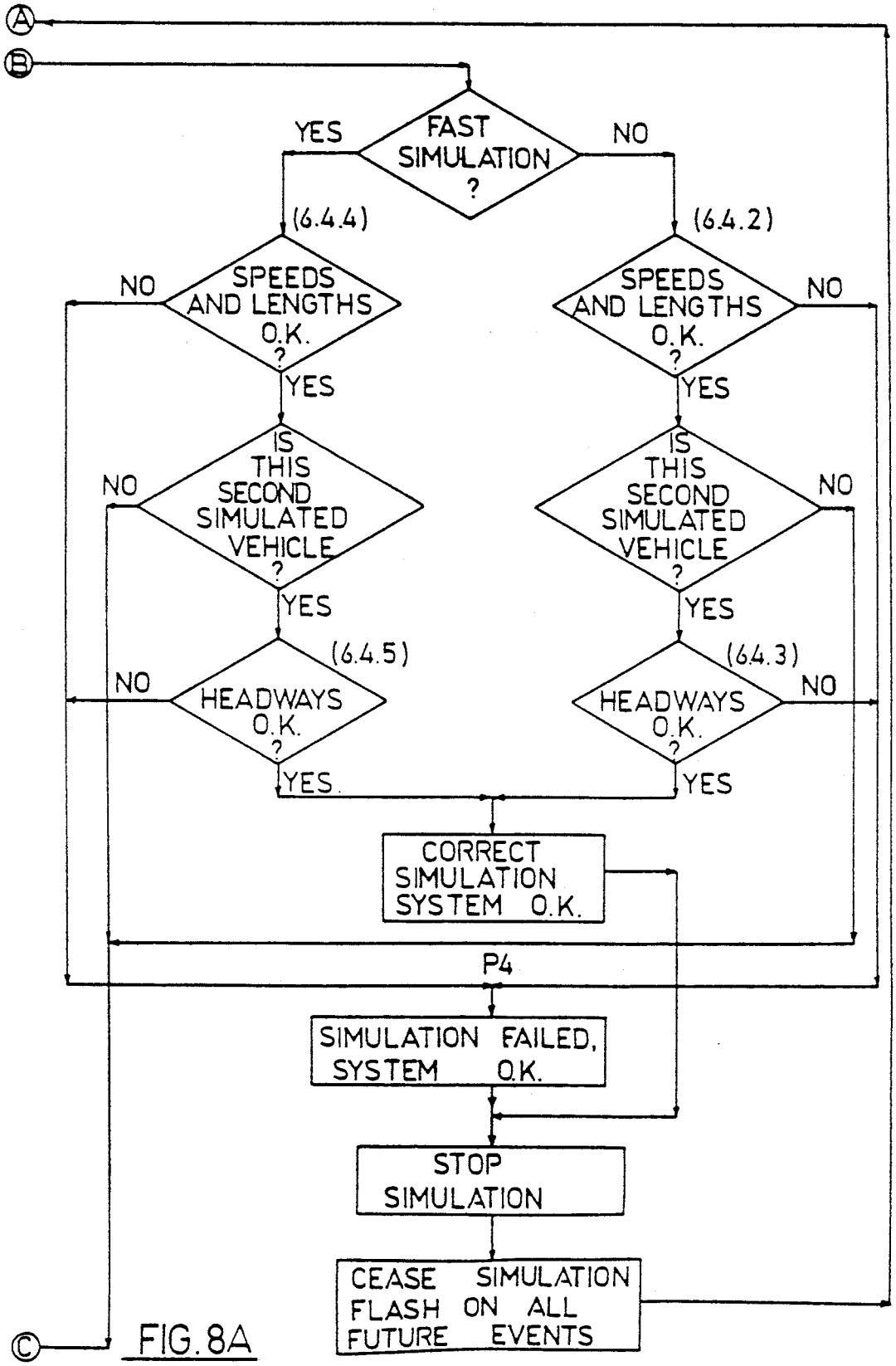

The calibration of the apparatus of the present invention proceeds generally as indicated in the flowchart of FIGS. 8 and 8A. The following calibrations are carried out:

Noise level: The output of photodetector amplifiers 39 must be below a given voltage when the beam is interrupted.

Power supply: The output of the power supply must be above a given voltage level.

Signal level: The output of photodetector amplifiers 39 in the presence of an uninterrupted beam must be no less than a given voltage.

Vehicle Simulation: Both slow and fast simulations are provided.

For the slow simulation, the speed of the vehicle is 60 its length is 4 meters and the headway is 1 second.

The hardware is caused to simulate the following events:

1. Source 1 On, source 2 On, wait 1000 msec
2. Source 1 Off, source 2 On, wait 30 msec
3. Source 1 Off, source 2 Off, wait 210 msec
4. Source 1 On, source 2 Off, wait 30 msec
5. Repeat beginning at 1 until a Simulation Stop is received.

For the fast simulation, the speed of the vehicle is 120 km/h, its length is 4 meters and the headway is 0.5 second.

The hardware is caused to simulate the following events:

1. Source 1 On, source 2 On, wait 500 msec
2. Source 1 Off, source 2 On, wait 15 msec
3. Source 1 Off, source 2 Off, wait 105 msec
4. Source 1 On, source 2 Off, wait 15 msec
5. Repeat beginning at 1 until a Simulation Stop is received.

The following constants are established:

verr: maximum % speed error permitted, preferably 1.5% lerr: maximum % length error permitted, preferably 1.5% herr: maximum % headway error permitted, preferably 1.5%

The speeds and lengths of the slow simulation are correct if and only if the following criteria are fulfilled:

Absolute value of (60 − v1) < 60 × verr AND

Absolute value of (60 − v2) < 60 × verr AND

Absolute value of (4 − L1) < 4 × lerr AND

Absolute value of (4 − L2) < 4 × lerr

The headways of the slow simulation are correct if and only if the following criteria are fulfilled:

Absolute value of (1 − h1) < 1 × herr AND

Absolute value of (1 − h2) < 1 × herr

The speeds and lengths of the fast simulation are correct if and only if the following criteria are fulfilled:

Absolute value of (120 − v1) < 120 × verr AND

Absolute value of (120 − v2) < 12033 verr AND

Absolute value of (4 − L1) < 4 × lerr AND

Absolute value of (4 − L2) < 4 × lerr

The headways of the fast simulation are correct if and only if the following criteria are fulfilled:

Absolute value of $(0.5-h1)<0.5\times herr$ AND

Absolute value of $(0.5-h2)<0.5\times herr$

It will be appreciated by persons skilled in the art that the present invention is not limited by what has been particularly shown and described hereinabove. Rather the scope of the present invention is defined only by the claims which follow:

We claim:

1. A traffic monitoring system comprising:

means for establishing a pair of precisely spaced radiation beams in association with a thoroughfare, whereby passage of a vehicle along the thoroughfare interrupts the radiation beams;

means for sensing interruption of the radiation beams and providing output indications of vehicle speed and separation between adjacent vehicles; and means for photographing vehicles fulfilling predetermined criteria including photography trigger apparatus which is responsive to the sensed vehicle speed of the vehicle being photographed for timing the acquisition of a photographic record of the vehicle, thereby providing a consistently positioned photographic record of the vehicle, irrespective of vehicle speed.

2. A system according to claim 1 further comprising means for providing a system calibration check and means for record confirmation of calibration together with a record of violations.

3. A system according to claim 1 further comprising means for distinguishing between separate cars and joined vehicles.

4. A system according to claim 1 further comprising means for photographing both a tailgating vehicle and a vehicle being tailgated.

5. A system according to claim 1 further comprising means for receiving and checking the output indications against stored data for determining consistency and for eliminating spurious output indications.

6. A system according to claim 5 wherein the stored data includes data pertaining to at least one of upper and lower speed, headway and vehicle length limits.

7. A system according to claim 1 further comprising means for providing to a monitor an output indication of traffic law violations in near real time.

8. A system according to claim 2 wherein the means for providing a system calibration check comprises means for simulating the passage of a vehicle through the system.

9. A system according to claim 1 further comprising means for determining the acceleration of a vehicle.

10. A system according to claim 9 further comprising means for rejecting output indications corresponding to accelerating or decelerating vehicles beyond predetermined limits.

11. A system according to claim 1 and also comprising flash means and dynamic trigger means operative to operate said flash means a predetermined time prior to operation of said photography trigger apparatus.

12. A system according to claim 1 and wherein said means for photographing also comprises for incorporating violation data in said photographic record.

13. A traffic monitoring system comprising:

means for establishing a pair of precisely spaced radiation beams in association with a thoroughfare, whereby passage of a vehicle along the thoroughfare interrupts the radiation beams: and means for sensing interruption of the radiation beams and providing output indications of violations in respect of excessive vehicle speed and insufficient separation between adjacent vehicles, wherein the means for sensing includes means for distinguishing between separate cars and joined vehicles, and automatically preventing the provision of an output indication of violation in respect of insufficient separation in the sensed presence of joined vehicles.

14. A system according to claim 13 further comprising means for photographing vehicles fulfilling predetermined criteria, including photography trigger apparatus which is responsive to the sensed vehicle speed of the vehicle being photographed for providing a consistently positioned photographic record of the vehicle, irrespective of vehicle speed.

15. A system according to claim 13 and wherein said means for sensing includes means for joining data received within a predetermined time span and relating it to a single vehicle.

16. A traffic monitoring system comprising:

means for establishing a pair of precisely spaced radiation beams in association with a thoroughfare, whereby passage of a vehicle along the thoroughfare interrupts the radiation beams;

means for sensing interruption of the radiation beams and providing output indications of vehicle speed, separation between adjacent vehicles and tailgating; and means responsive to sensed tailgating for photographing not only a tailgating vehicle but also a vehicles being tailgated.

17. A traffic monitoring system comprising:

means for establishing a pair of precisely spaced radiation beams in association with a thoroughfare, whereby passage of a vehicle along the thoroughfare interrupts the radiation beams;

means for sensing interruption of the radiation beams and providing output indications of vehicle speed and separation between adjacent vehicles; and means for checking the output indications for consistency against stored data so as to eliminate spurious output indications.

18. A system according to claim 17 and wherein said stored data includes at least one of upper and lower speed, headway and vehicle length limits.

19. A system according to claim 17 and wherein said stored data includes at least one of signal level, noise level and power level limits.

* * * * *